United States Patent [19]

Mian

[11] 4,332,334

[45] Jun. 1, 1982

[54] DUSTLESS BAG BREAKER

[76] Inventor: Thomas T. Mian, 701 Huntington Commons, Unit 412, Mount Prospect, Ill. 60056

[21] Appl. No.: 152,378

[22] Filed: May 22, 1980

[51] Int. Cl.[3] ..... B67B 7/24

[52] U.S. Cl. ..... 222/83.5; 222/88; 222/203

[58] Field of Search ..... 222/82, 87, 203, 80, 222/81, 83, 84, 85, 86, 88, 89, 90, 83.5, 91; 141/1, 106, 284, 329, 330, 19, 364–366, 392, 10, 114

[56] References Cited

U.S. PATENT DOCUMENTS 3,651,838 3/1972 Albert ..... 141/364

*Primary Examiner*—Frederick R. Schmidt

*Attorney, Agent, or Firm*—Fitch, Even, Tabin, Flannery & Welsh

[57] ABSTRACT

An automatic bag breaking system in which a bag of powdered material is opened and emptied within a protective enclosure. The enclosure is equipped with a bag holding assembly and at least one flapper to sequentially strike the bag after the bag is cut to enhance discharge of the bag's contents within the protective enclosure.

19 Claims, 5 Drawing Figures

10
20
40
40a
20a
30
17
36
18d
2.
34
45
56
55
18a
60
38
33
42
49
47
18
54
59
58
16
2.
18b
18c
50
53
22
44
52
48
24
26
28
25

DUSTLESS BAG BREAKER

DESCRIPTION

1. Technical Field of Invention

This invention relates to a dustless bag breaker, and more particularly, to an apparatus for automatically opening and emptying a bag of dry dusty material in a protective enclosure.

2. Background of the Invention

Numerous industries, such as chemical, food processing and water treatment industries, utilize dry dusty materials which are packaged in bags. The bags can be made of paper, plastic, or fabric and can be either single layered or multi-walled depending on the particular material contained in the bag and the desired bag size and weight. Among the many dry dusty materials that are packaged in bags are toner for photocopying machines, powdered cement, and other powdered material as well as fibrous materials which emit a dust when emptied in large quantities from a bag, such as asbestos and steel wool.

Over the years, various types of devices have been developed for emptying the powdered material from a bag in a dust-tight enclosure. These devices have included pushers for compressing the bag, overhead rails upon which the bags can travel, spears for penetrating the bag and jaws for moving the bag. These devices have met with varying degrees of success. Typifying such devices are those shown in U.S. Pat. Nos. 2,107,995, 3,171,449, 3,599,682 and 3,651,838.

In one prior art system, the cover of the bag is torn by hand or manually cut with a knife, and the bag is then turned upsidedown and shaken by the operator to dump the contents of the bag into a vessel. Such manual bag opening, shaking and dumping creates dust problems, such as breathing problems, respiratory ailments, loss of material to the atmosphere, explosion hazard, eyesight and visibility impairment, material contamination during transfer and dangerous and slippery working conditions. Furthermore, such manual bag opening, etc. is burdensome and time consuming. These problems become aggravated when numerous bags must be opened and emptied.

In another type of prior art system, the operator throws the filled bag over a sharp edge mounted on top of a grating and drags the filled bag through the sharp edge to slit the bottom of the bag, so as to partially empty the contents of the bag over the grating. Thereafter, the bag is manually lifted and shaken to empty the remaining contents in the bag. The problems associated with this system are similar to those described above.

In still another prior art system, the operator places the filled bag on the inside of a horizontal door of a box by lifting the door, inserting the bag and shutting the door. When the operator shuts the door, a protruding sharp edge from the bottom of the box penetrates the bottom of the bag to form an opening in the bag. While some of the contents of the bag will fall out under the action of gravity, the remaining contents of the bag have to be manually removed by shaking the bag as discussed above. Problems similar to those described above are also encountered in this system.

It is therefore desirable to provide an improved method and apparatus for safely and efficiently opening and emptying bags of dry dusty material.

SUMMARY OF THE INVENTION

An improved method and apparatus is provided which safely, efficiently and automatically opens and empties bags of dry dusty material. The method includes positioning the filled bag in a protective enclosure and, thereafter, cutting and beating the bag to enhance discharge of the bag's contents. In the preferred method, the bag is positioned horizontally when it is cut and beaten.

While various systems and devices can be used to carry out the above method, one preferred type of system for carrying out the above method utilizes my new dustless bag breaker in which the bag is held in a dust-tight container by a bag-holding assembly and is cut by a cutter, such as a rotatable circular knife. The dust-tight container has wall portions which substantially confine dust emitted from the bag when the bag is emptied. At least one of the walls has a discharge outlet for dispensing the bag's contents when the bag is opened by the cutter.

In the preferred form, the bag-holding assembly holds the bag stationary in a generally horizontal position within the container. To accommodate horizontal positioning of the bag within the container, the container's walls must horizontally span a distance greater than the length of the bag and must be of a height greater than the maximum thickness of the bag when filled.

In the illustrative embodiment, the horizontal bag-holding assembly has arms, that support the bag from its underside, and overhead pinchers which cooperate with the arms to clamp the bag in a horizontal position. Preferably, each arm has an upright pin that penetrates and securely holds the underside of the bag.

In order to enhance discharge of the bag contents after the bag is opened, at least one flapper is operatively positioned within the dust-tight container. In the preferred form, at least two flappers are positioned on opposite sides of the cutter to sequentially strike the bag. Preferably, the flappers rotate about a common shaft with the cutter and are driven by the same power source as the cutter. In the illustrative embodiment, the flappers extend radially from the shaft and are flexible.

A more flexible explanation of the invention is provided in the following description and appended claims, all taken in conjunction with the accompanying drawings.

DETAILED DESCRIPTION OF THE PREFERRED EMBODIMENT

Figure 1:
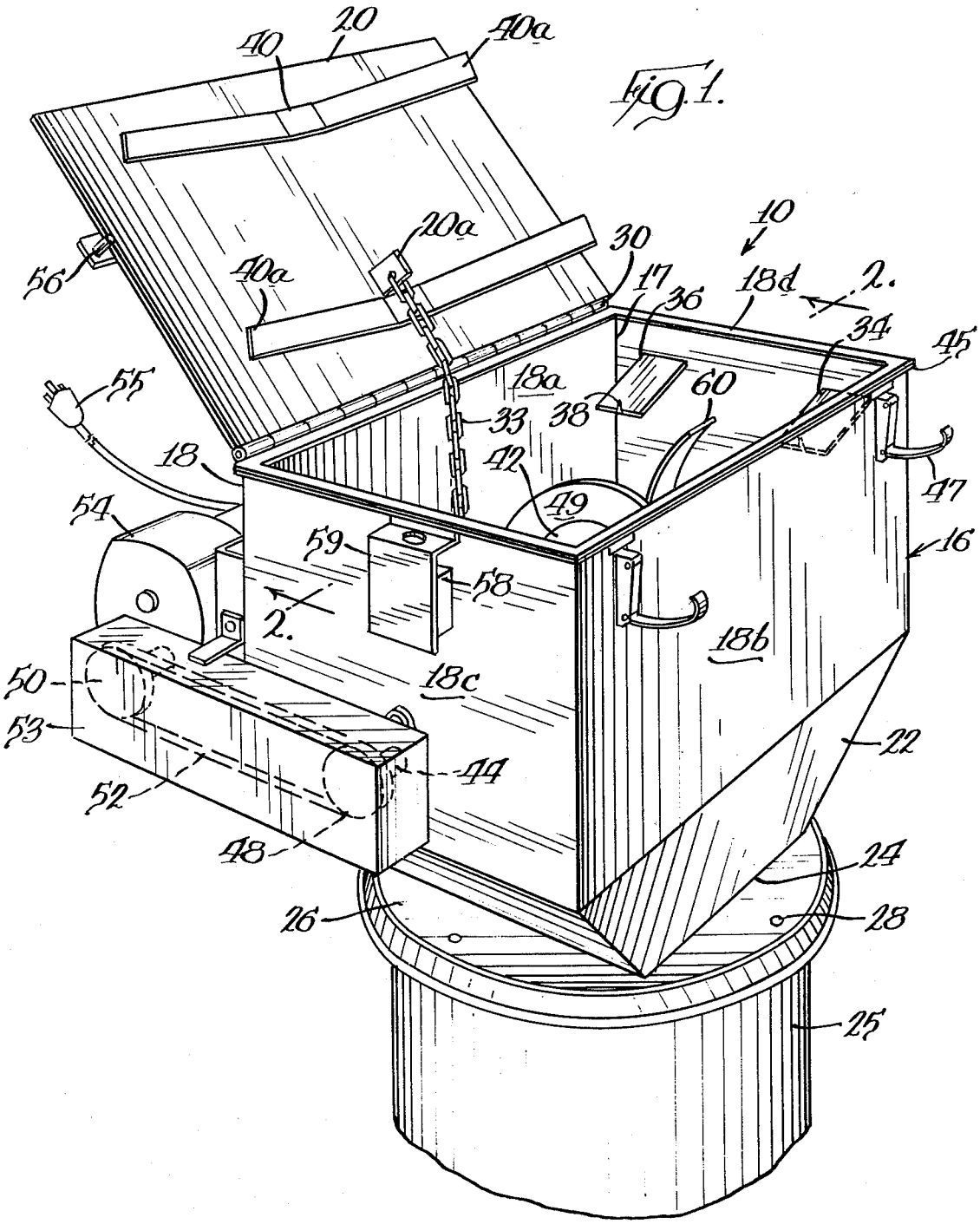
FIG. 1 is a perspective view of a dustless bag breaker in accordance with principles of the present invention.

Referring to the drawings, a system is provided in which a dust-confining dispenser or dustless bag breaker 10 automatically opens and empties a bag 12 of relatively dry dusty material 14. While various size and shaped bags can be used with dustless bag breaker 10, dustless bag breaker 10 is particularly useful with standard rectangular pillow-like bags made of plastic, paper or fabric.

Bag breaker 10 has a dust-tight box-like container 16 that provides a protective enclosure with an interior 17 which defines a sealed environment and dispensing zone for containing bag 12 and confining the dusty material dispensed therefrom. Dust-tight container 16 is made of rigid dust-impervious material, such as metal or impact-resistant plastic. Container 16 has a main body portion 18, a pivotable hinged lid, top or cover 20 and a frusto-conical discharge chute or hopper 22 extending below the main body portion 18. Chute 22 has a discharge opening 24 at its bottom end for dispensing dusty material 14 from bag 12 into a collection vessel or receptacle 25 (FIG. 1). An annular flange or collar 26 extends horizontally from the bottom of chute 22 about discharge opening 24 and has bolt holes 28 therein for use in mounting the container 16 to the collection vessel 25.

Lid 20 is pivotably connected to main body portion 18 via hinge 30 and covers the entire top of container 16 when closed. In the illustrative embodiment, lid 20 is generally planar or flat. A manually graspable handle 32 (FIGS. 2–5) is secured to the top of lid 20 to enable the operator to pivot the lid between open and closed positions. When lid 20 is opened, as shown in FIG. 1, the top of container 16 provides an access opening into which bag 12 can be inserted or removed.

Lid 29 has a chain link or metal stub 20*a* (FIGS. 1 and 2) welded thereto to which the top of a chain 33 is connected. The bottom of chain 33 is connected to a horizontal chain link or metal stub 35 (FIG. 3) which is pivotably connected to an arcuate support member 37, via pivot pin 39. Arcuate support member 37 is welded or otherwise secured to the inside of back wall 18*a*. Chain 33 restrains the lid 20 (FIG. 1) from opening beyond a predetermined amount. In order to support lid 20 and assist in preventing lid 20 from opening beyond a predetermined amount, an inclined brace 41 (FIG. 3) with a rubber pad or cushion 43 thereon is connected to the upper portion of back wall 18*a*. Brace 41 cooperates with chain 33 to provide lid limiting means which effectively limits the extent to which lid 20 can be opened.

In order to assist in providing moisture and dustproof operation, a gasket or seal 45 is mounted along the edge of the top of main body portion 18 to form a fluid tight seal between lid 20 and main body portion 18.

Container 16 must be large enough to easily fit bag 12 (FIG. 4) in a horizontal position. To this end, main body portion 18 encloses an area substantially greater than the maximum cross-sectional area of the bag as viewed in top plan view. In the illustrated embodiment, main body portion 18 has parallel sidewalls 18*a* and 18*b* (FIG. 1) that provide the back and front of container 20, respectively, and has parallel end walls 18*c* and 18*d* that extend between and connect sidewalls 18*a* and 18*b*. In order to comfortably seat bag 12 in the horizontal position, sidewalls 18*a* and 18*b* span a horizontal distance or length greater than the maximum length of bag 12 and are of a height greater than the maximum thickness of bag 12 when filled. Walls 18*a*–18*d* are of the same height.

A bag holding assembly 34 (FIG. 4) holds bag 12 horizontally within container 16. Bag holding assembly 34 has four generally planar or flat arms 36 that are securely cantilevered and slope downward from the top portion of end walls 18*c* and 18*d*. Arms 36 are made of a relatively strong material, such as spring-like metal, for supporting the weight of bag 12.

Each arm 36 has an upright pin 38 in the form of a cone point or apex that extends upwardly from the unattached, free inward end of arm 36. In the illustrative embodiment, pins 38 are ½ inch long and are welded to the top of arms 36. Pins of other sizes can also be used.

As bag 12 is placed on top of pins 38, the weight of material 14 in bag 12 causes pins 38 to vertically penetrate and securely hold the bottom wall of bag 12. Holding bag 12 in place is desirable because if the bag 12 fell into the bottom of container 16, it would choke up discharge opening 24. Furthermore, if the bag 12 were not securely held, it could be cut into shreds and be commingled with and contaminate the dispensed material 14.

Bag holding assembly 34 also has clips or pinchers 40 whose middle section or bight is connected to the underside of lid 20. Clips 40 extend downward from lid 20 and cooperate with arms 36 to clamp bag 12 in a horizontal position. In the illustrative embodiment, there are two clips which extend almost entirely across lid 20. Each of the clips 40 has a longitudinally extending, downwardly sloping elongated finger or clip portion 40*a* which is partially positioned above and aligned in registration with one of the arms 36. Clips 40 are preferably made of resilient material, such as spring-like metal.

Figure 4:
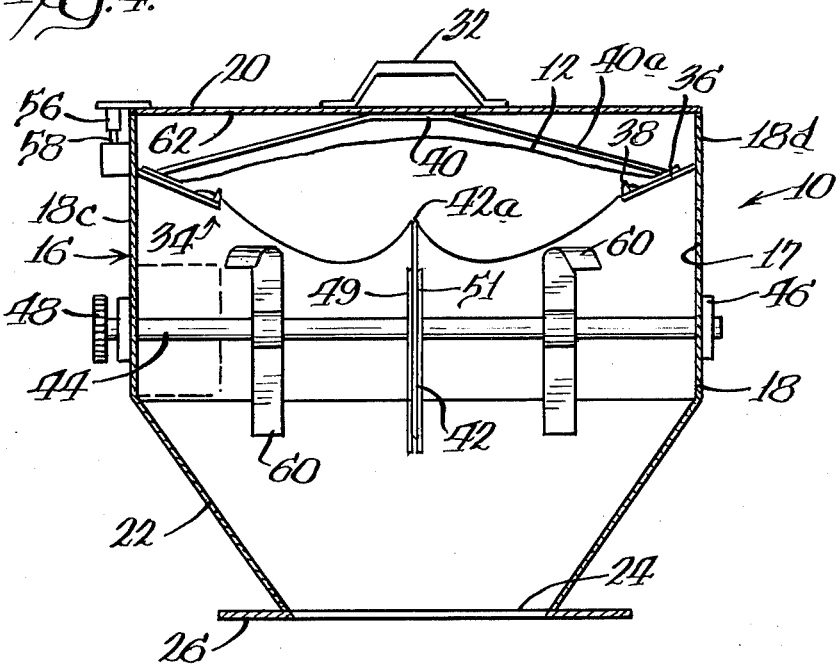
FIG. 4 is a reduced fragmentary cross-sectional view of the dustless bag breaker, somewhat similar to FIG. 2, but illustrating the flappers when positioned in parallel alignment with each other and showing a bag positioned in the dustless bag breaker before the cutter is activated.
Figure 5:
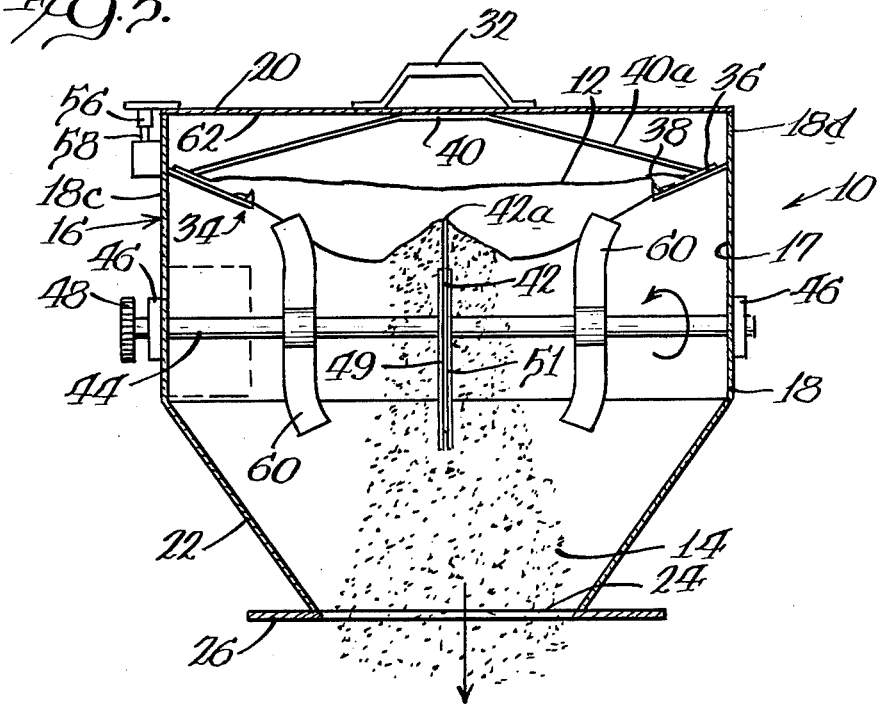
FIG. 5 is a view similar to FIG. 4, but showing the dustless bag breaker and bag after the cutter and flappers are activated.

A rotatable cutter 42 is provided to cut bag 12 within container 16. Cutter 42 is in the form of a circular knife that has a smooth circular blade and edge 42*a* (FIGS. 2–5) that is not serrated or jagged, like a saw blade. Circular knives are advantageous over circular saw blades which have a tendency to rip the bag into unwanted shreds which sometimes fall into and contaminate the collected material 14. Circular knife 42 is positioned below bag 12 (FIG. 4) at a location to supportingly engage the filled bag when the knife is stationary so as to hold up the bag in its center when the bag is placed on top of arms 36. Of course, knife 42 will cut bag 12 when the knife is rotated as shown in FIG. 5. Preferably, a pair of blade guards 49 and 51 protect blade 42.

Cutter 42 is mounted on rotatable shaft 44 (FIGS. 2–5) which extends across container 16. Shaft 44 is journalled and supported near its ends by bearings 46. A driven sprocket 48 is mounted at the left end of shaft 44 (as viewed from the front) and is driven by drive sprocket 50 (FIG. 1) via flexible drive chain 52. A chain guard or housing 53 encloses sprockets 48 and 50 and drive chain 52. Drive sprocket 50 is driven by motor 54 having outlet plug 55.

Motor 54 is activated in response to closing of lid 20 by use of a pin-like activator 56 that extends downwardly from the left hand edge of the lid 20 and engages limit switch 58 on the left hand portion of end wall 18*c* when lid 20 is closed. Limit switch 58 is protected by an apertured L-shaped housing 59.

Motor 54 and the associated drive components therefor provide power means for driving shaft 44 and the cutter 42 and flappers 60 thereon.

In order to enhance discharge of the dusty material 14 from the bag 12, flappers, beaters, or vanes 60 are operatively mounted within the container 16. In the preferred embodiment, two or more flappers 60, made of a relatively flexible material, such as rubber or plastic, are mounted on shaft 44 on opposite sides of cutter 42 so as to extend radially from and diametrically across shaft 44. In order to keep the load on shaft 44 balanced, the same number of flappers should be positioned to the right of cutter 42 as are positioned to the left of cutter 42 on shaft 44, with shaft 44 providing a common axis of rotation for cutter 42 and flappers 60.

Figure 2:
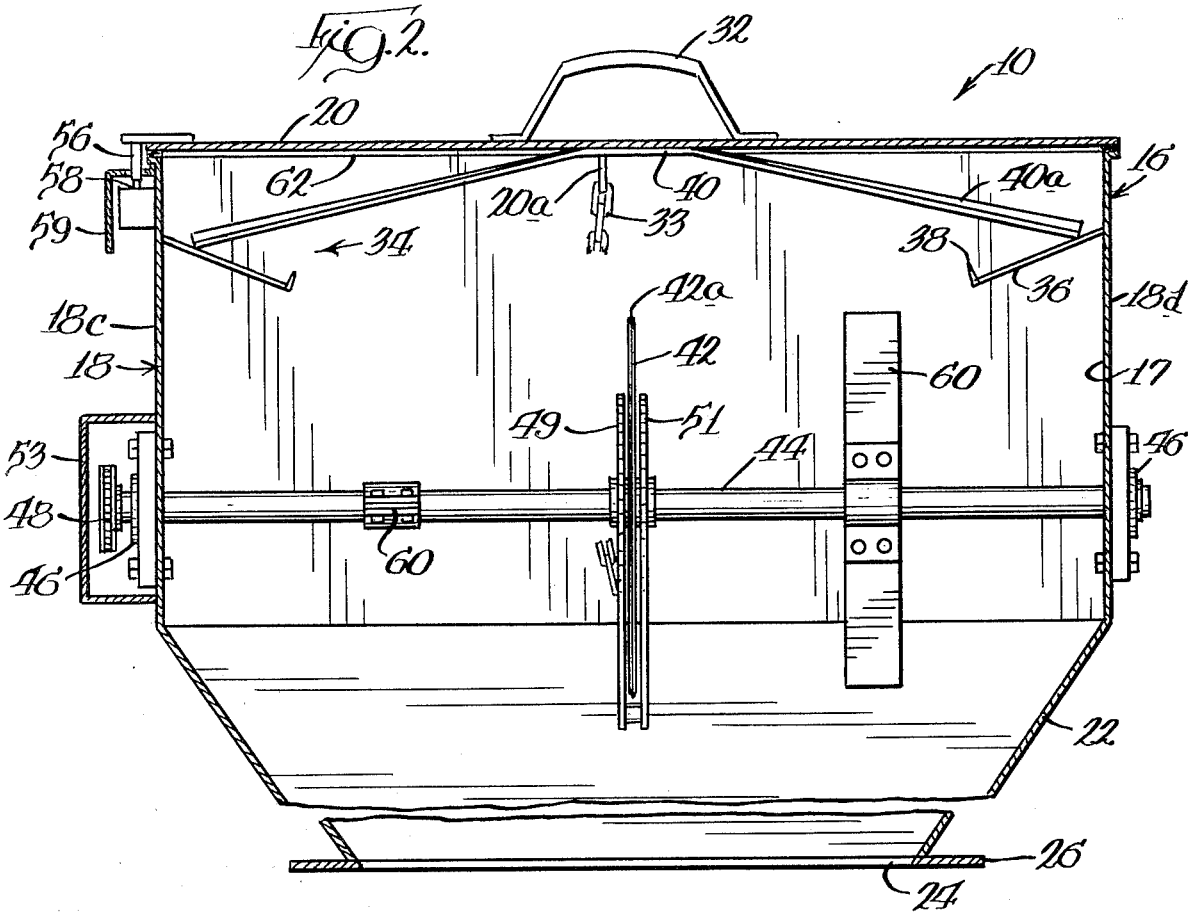
FIG. 2 is a fragmentary cross-sectional view of the dustless bag breaker with the front wall removed for purposes of clarity and with the lid closed.
Figure 3:
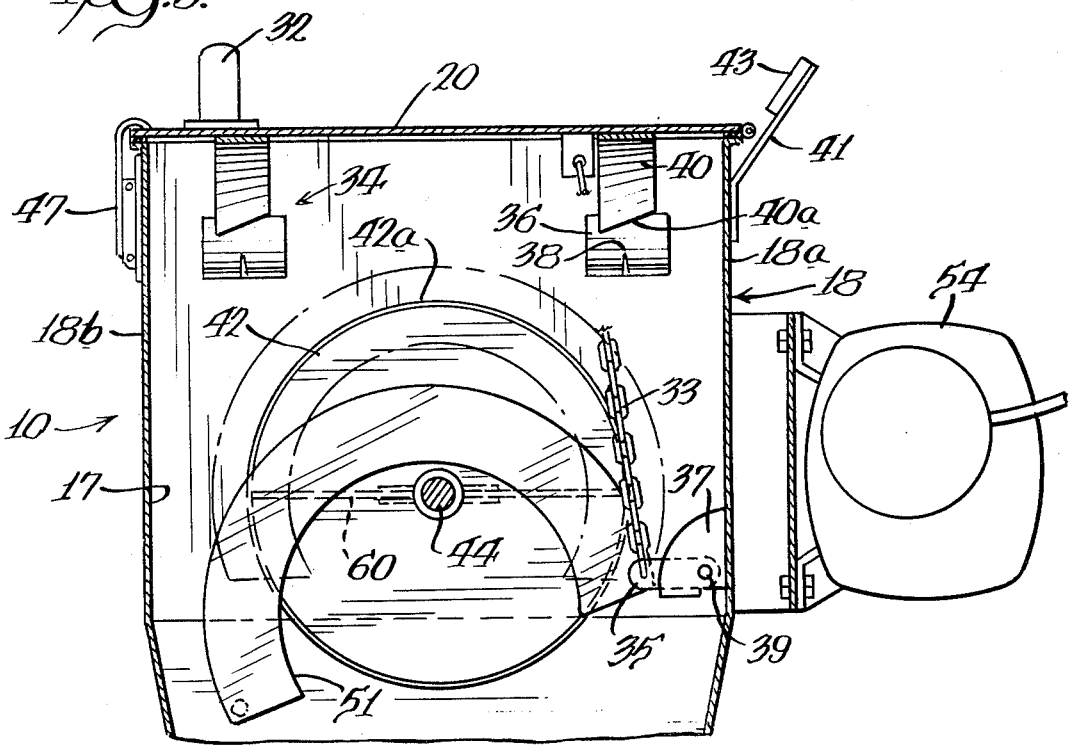
FIG. 3 is a fragmentary cross-sectional view of the dustless bag breaker with one of the end walls removed for purposes of clarity.

Flappers 60 firmly flap, strike and beat the bottom of the bag 12 after bag 12 is cut to move and discharge the material in the bag towards the bag's center where the bag has been slit by cutter 42 to enhance discharge of the powdered material 14 from bag 12. The flappers can be mounted in parallel alignment with their ends oppositely curled as shown in FIGS. 4 and 5, or can be mounted in offset relationship to each other, such as at right angles and/or with their ends uncurled and straight as shown in FIG. 2.

With the top and bottom edges of bag 12 being held in place by bag holding assembly 34 and the weight of the content of the powdered material moving by gravity and flapping towards the bag's opening in the center, the dustless bag breaker completely empties and elminates local dead pockets of accumulated powdered material 14.

In the illustrative embodiment, each flapper is made of rubber and has a thickness in the range from about $\frac{1}{8}$ inch to about $\frac{3}{8}$ inch with a width in the range from about 1 inch to about 2 inches. While flappers having the above dimensions are particularly advantageous, flappers having other dimensions and shapes can also be used.

In operation, lid 20 is opened and bag 12 is placed on arms 36. The weight of bag 12 will cause pins 38 (FIG. 4) of arms 36 to penetrate the lower portion of bag 12. Thereafter, lid 20 is closed causing pinchers 40 to abut against the upper surface of bag 12 and coact with arms 36 to clamp bag 12 in a horizontal position. Closing of lid 20 will activate limit switch 58, via activating pin 56, energizing motor 54 to drive cutter 42 and flappers 60. Cutter 42 cuts a slit in bag 12 from which the powdered material 14 contained within bag 12 can fall by gravity through discharge outlet 24. Rotating flappers 60 rotatably flap against bag 12 enhancing discharge of the powdered material therein.

Dust created by the falling dry material 14 is contained within the protective enclosure 16 to protect the operator from breathing dust. Most of the dust is carried down by the falling powdered material 14, and the remaining dust settles down in the container in a short period of time. For one type of bag, bag opening and emptying took 20 seconds with most of the dust settling out between 60 and 90 seconds. After bag 12 is emptied, lid 20 is opened and the bag removed.

Although embodiments of the invention have been shown and described, it is to be understood that various modifications and substitutions, as well as rearrangement of parts, can be made by those skilled in the art without departing from the novel spirit and scope of this invention.

What is claimed is:

1. A dispenser for dispensing dusty material from a bag, comprising:

a container for receiving a bag and defining a discharge outlet for dispensing said dusty material;

bag holding means for holding said bag in a generally horizontal position within said container;

a rotatable cutter for cutting said bag within said container; and at least one rotatable flapper positioned about a common axis of rotation with said cutter within said container for beating said bag after said bag is cut to enhance discharge of said dusty material from said bag.

2. A dispenser in accordance with claim 1 further including drive means for driving said flapper and said cutter.

3. A dispenser in accordance with claim 1 including a rotatable flapper positioned on each side of said cutter along said common axis of rotation.

4. A dispenser in accordance with claim 1 wherein said flapper extends radially from said common axis of rotation.

5. A dispenser in accordance with claim 1 wherein said flapper has flexible portions.

6. A dispenser in accordance with claim 1 wherein said rotatable cutter is positioned beneath said bag to engageably support said bag when said cutter is stationary.

7. A dispenser in accordance with claim 6 wherein said cutter includes a knife having a generally smooth circular edge.

8. A dispenser in accordance with claim 1 wherein said container has a pivotable cover with a manually graspable handle for pivoting said cover between an open and closed position.

9. A dispenser in accordance with claim 8 including power means for driving said flapper and said cutter and switch means for activating said power means in response to said cover being closed.

10. A dispenser in accordance with claim 1 wherein said bag holding means includes a plurality of arms for supporting said bag in a generally horizontal position.

11. A dispenser in accordance with claim 10 wherein each of said arms has a generally upright pin for penetrating portions of said bag.

12. A dispenser in accordance with claim 10 wherein said bag holding means further includes a plurality of clips cooperating with said arms for clamping said bag in a generally horizontal position.

13. A dispenser for dispensing dusty material from a bag, comprising:

a container for receiving a bag and defining a discharge outlet for dispensing said dusty material;

bag holding means for holding said bag within said container;

cutting means for cutting said bag within said container; and at least one flapper operatively positioned within said container for striking said bag after said bag is cut to enhance discharge of said dusty material from said bag.

14. A dispenser in accordance with claim 13 further including power means for driving said flapper.

15. A dispenser in accordance with claim 13 further including a shaft operatively connected to said flapper for moving said flapper, and said flapper extends radially outward from said shaft.

16. A dust-confining dispenser in accordance with claim 13 wherein said flapper has flexible portions.

17. A dustless bag breaker for opening and emptying a generally rectangular pillow-like bag of relatively dry powdered material, comprising:

a box-like container providing a protective enclosure for receiving a generally rectangular pillow-like bag of relatively dry powdered material and for substantially confining said powdered material emitted therefrom, said container having a main body portion, a pivotable lid covering said main body portion and a frustoconical discharge chute extending below said main body portion for dispensing said dusty material, said lid having a manually graspable handle portion for pivoting said lid between a closed position and an open position;

bag holding means for holding said bag in a generally horizontal position, said bag holding means including a plurality of arms cantilevered from and connected to said main body portion and a plurality of clips extending downwardly from and connected to said lid for cooperating with said arms to clamp said bag in said generally horizontal position, each of said arms having a generally upright pin for penetrating and holding portions of said bag;

a rotatable circular knife having a generally smooth circular blade positioned below said bag at a location to supportingly engage said bag when said knife is stationary and for cutting said bag when said knife is rotated;

a shaft upon which said rotatable knife is mounted, said shaft extending across said main body portion;

power means for rotating said shaft in response to said lid being closed; and at least two relatively flexible flappers extending radially from said shaft on opposite sides of said circular blade for beating said bag after said bag is cut to enhance discharge of said powdered material from said bag.

18. A dustless bag breaker in accordance with claim 17 wherein said flappers are positioned at about right angles to each other.

19. A dustless bag breaker in accordance with claim 17 further including lid limiting means for limiting the extent to which said lid can be opened, said lid limiting means including a chain for restraining the lid from opening beyond a predetermined amount and a inclined brace connected to said main body portion for supporting said lid and for preventing said lid from opening beyond said predetermined amount.

* * * * *